US005988631A

United States Patent [19]

Hewit

[11] Patent Number: 5,988,631

[45] Date of Patent: Nov. 23, 1999

[54] SHEET TRANSPORT DEVICE

[75] Inventor: James R. Hewit, Newport-on-Tay, United Kingdom

[73] Assignee: NCR Corporation, Dayton, Ohio

[21] Appl. No.: 09/081,236

[22] Filed: May 19, 1998

[30] Foreign Application Priority Data

May 24, 1997 [GB] United Kingdom ..... 9710718

[51] Int. Cl.[6] ..... B65H 29/24

[52] U.S. Cl. ..... 271/195; 406/10; 406/194

[58] Field of Search ..... 271/195, 194; 406/10, 19, 85, 95, 194, 195

[56] References Cited

U.S. PATENT DOCUMENTS 3,237,933 3/1966 Grosswiller, Jr. et al. ..... 406/10 X
3,243,181 3/1966 Lyman .
3,294,342 12/1966 McClure et al. ..... 406/10 X
4,113,247 9/1978 Phillips .
5,425,217 6/1995 Lobush et al. ..... 271/195 X

FOREIGN PATENT DOCUMENTS 0690423 1/1996 European Pat. Off. .

*Primary Examiner*—David H. Bollinger

[57] ABSTRACT

A device (10) to transport sheets such as bank notes (30) comprises a rectangular tube (12) along which there is a flow of air F, the tube having pairs of independently addressable computer controlled flaps (14,16,18,20,22) on opposite internal walls. The pairs of flaps are controlled to project into the tube so as to reduce its height, and cause a local Venturi effect; by operating one or more pairs of flaps at a time in sequence, the Venturi effect moves along the tube, carrying the bank note by a surfing action.

13 Claims, 3 Drawing Sheets

SHEET TRANSPORT DEVICE

BACKGROUND OF THE INVENTION

This invention relates to a device for transporting sheets, for example paper sheets such as bank notes. One application of a sheet transport device is in an automated teller machine (ATM) in which bank notes are kept in a secure central store, and are supplied to the ATM on demand. Since the ATM then does not hold cash, it is no longer a target for robbery.

Previously proposed arrangements for supplying bank notes from a central store include mobile robots or guided vehicles, which are expensive and open to attack. Pneumatic tubes have been used, but require a piston-like carrier which must be loaded and unloaded with bank notes, a complex operation.

SUMMARY OF THE INVENTION

It is an object of the invention to provide a sheet transport device which is easy to install and to configure and reconfigure.

According to the invention there is provided a sheet transport device comprising a tube, characterized by means to provide a flow of air along the tube, and pressure variation means arranged to cause a local Venturi effect to pass along the tube.

Preferably the pressure variation means comprises means to reduce the cross sectional area of the tube. The tube will usually be of rectangular cross section and may comprise a plurality of independently operable flaps, arranged in pairs on opposite sides of the tube.

BRIEF DESCRIPTION OF THE DRAWINGS

The invention will now be described by way of example only with reference to the accompanying drawings in which.

DETAILED DESCRIPTION

Figure 1:
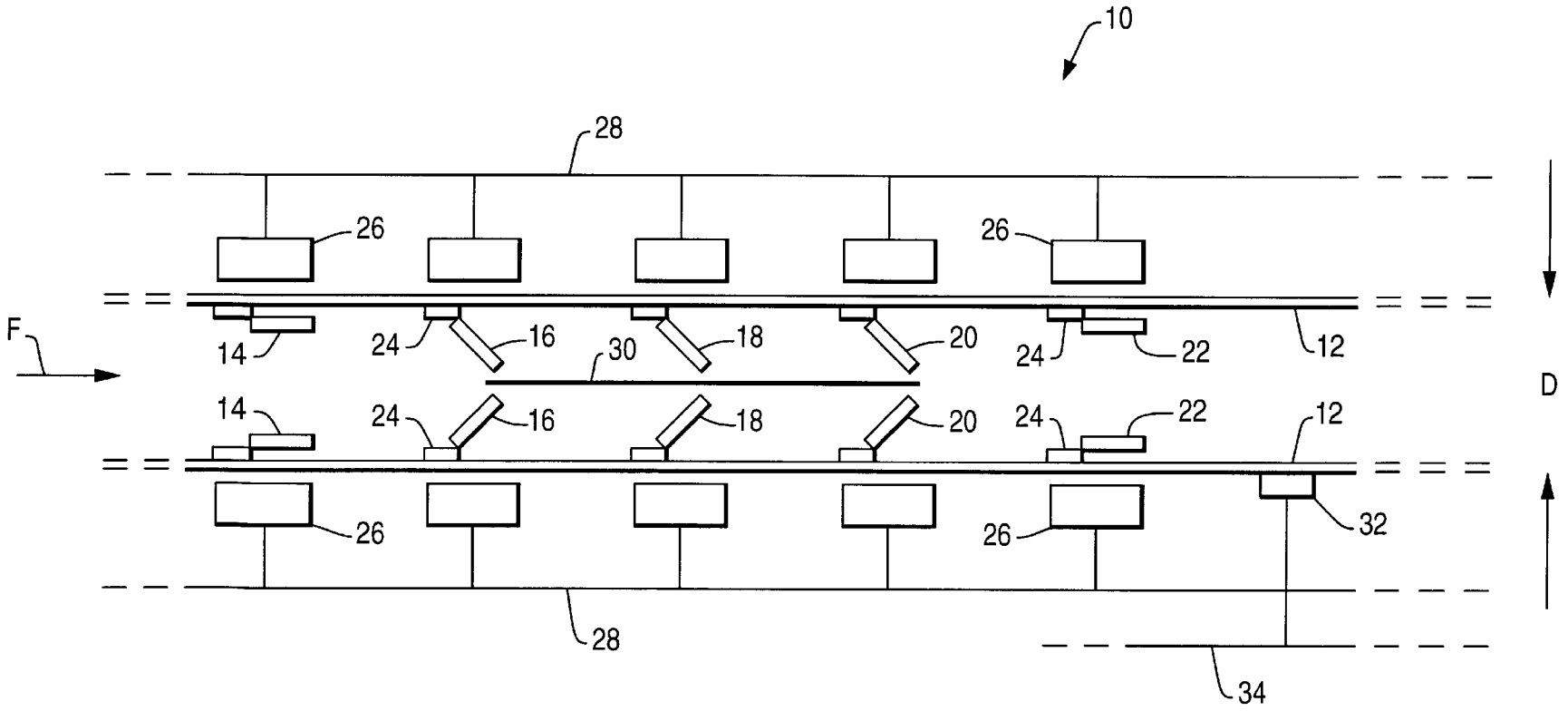
FIG. 1 is a schematic longitudinal section of a short length of a sheet transport device.

In FIG. 1 the sheet transport device 10 comprises a tube 12 of rectangular cross section and having a plurality of pairs of micro-engineered flaps 14,16,18,20,22 on its upper and lower internal walls. Each flap is supported on a pivot 24 and has an adjacent addressable actuator 26 connected to a control cable 28. A current of air flows along the tube in the direction of the arrow F. A bank note 30 is shown being transported along the tube 12.

Figure 2:
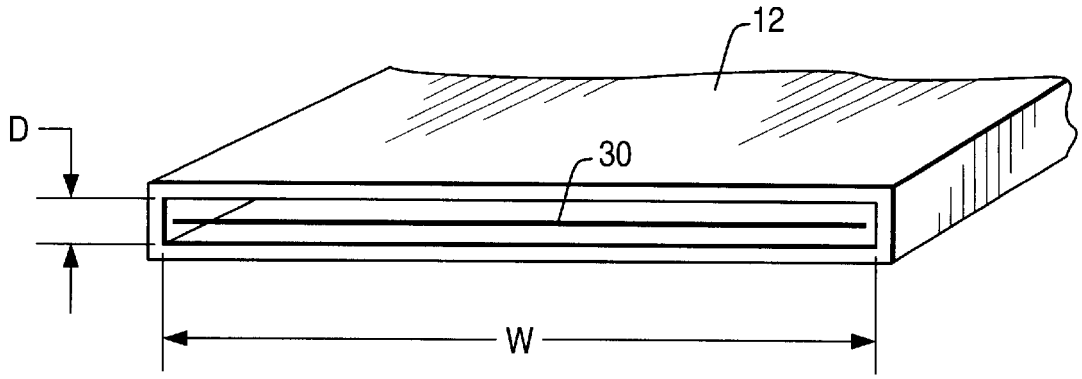
FIG. 2 is a cross sectional view of the tube shown in FIG. 1.

FIG. 2 shows that the rectangular tube 12 is of height D and width W, where W is slightly larger than the width of the bank note 30, and W>>D.

Figure 3A:
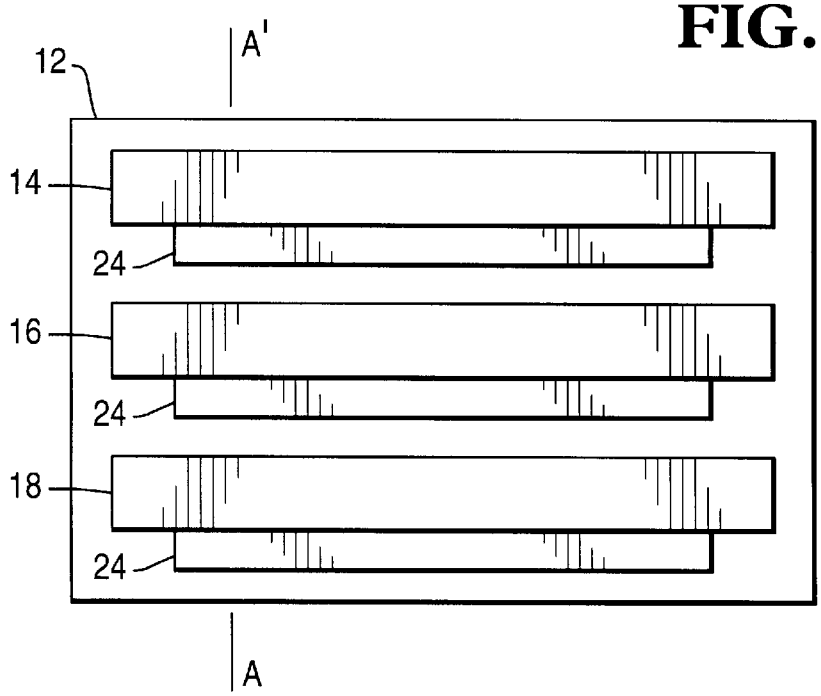
FIG. 3(*a*) is a view of the lower interior surface of a short length of the tube, and FIG. 3(*b*) is a section along the line AA'.
Figure 3B:
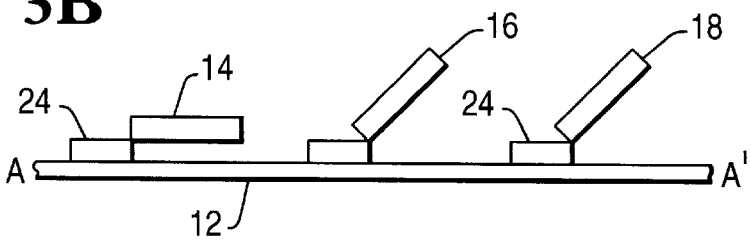

In FIG. 3*a,* the flaps 14,16 and 18 in the lower surface of the tube 12 are shown; each flap extends across almost the full width of the tube, the supporting pivots 24 being shorter than the flaps in this direction. FIG. 3*b* is a cross section along the line AA', showing flap 14 lying against the inner surface of tube 12, while flaps 16 and 18 are pivoted towards the center of the tube, as shown in FIG. 1.

Referring once more to FIG. 1, the opposite pairs of flaps 16,18 and 20, supported on their respective pivots 24 so as to project towards each other into the tube 12, have the effect of reducing the depth of the tube from D to about D/2. Since there is a flow of air along the tube 12, and since the flaps project in the same direction as the flow, the effect is to create a local Venturi effect, i.e. pressure energy of the air flow is converted into kinetic energy by acceleration through the reduced depth of tube.

The addressable actuators 26 are computer controlled, and are arranged so that pairs of flaps project in a sequence which moves along the tube 12 in the same direction as the air flow. At any time, 3 pairs of flaps project. The local Venturi effect travels along the tube in the same direction as the air flow, and the note 30 is transported, by a surfing action, along the tube. The opening and closing of the pairs of flaps can be regarded as equivalent to a "Mexican wave".

To ensure that the note 30 is retained in the Venturi effect, note sensors 32 connected to a sensor cable 34 are provided at intervals along the tube. If the note 30 tends to lag or lead the sequence of flap movements, the appropriate adjustments of flap sequence are made.

Figure 4:
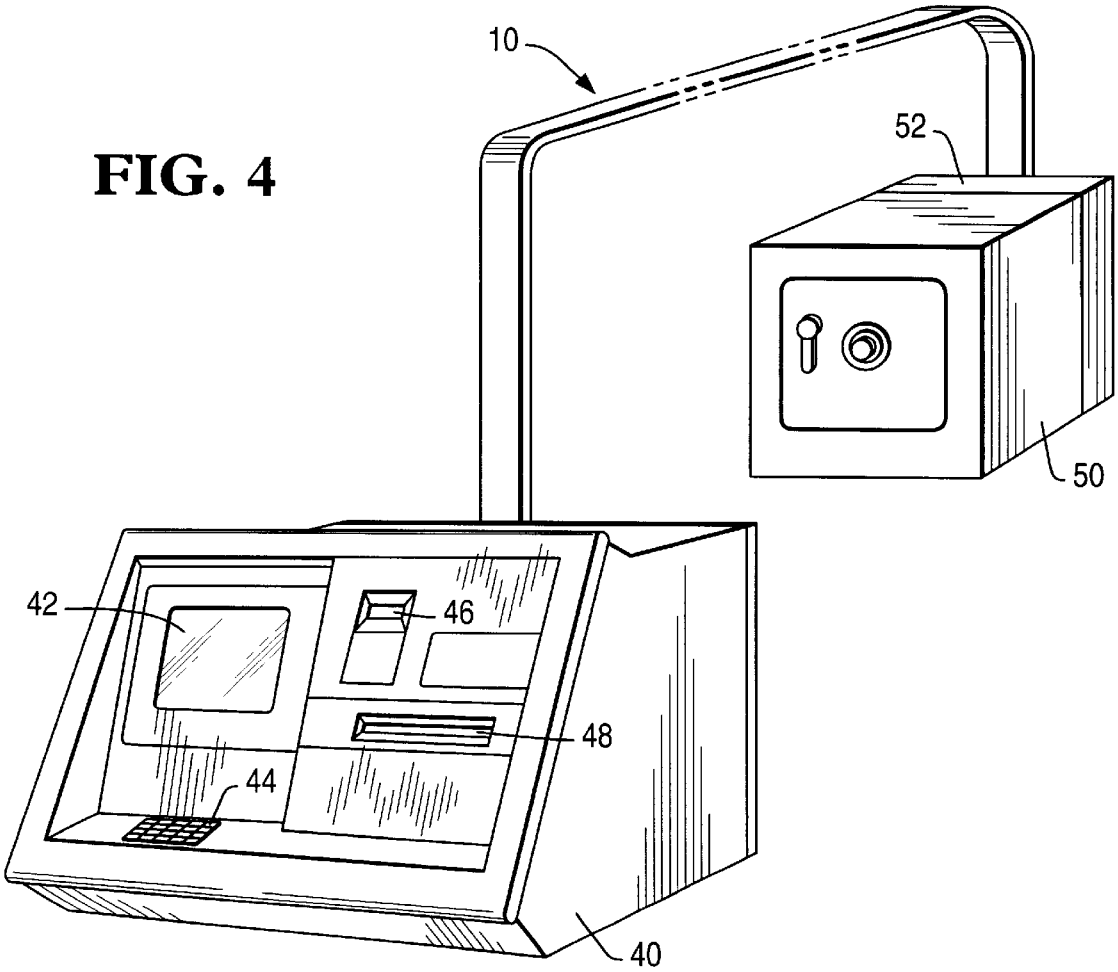
FIG. 4 shows the inventive device in use to supply an ATM.

In FIG. 4, an ATM 40 has a conventional display screen 42, input keypad 44, card slot 46 and bank note delivery slot 48. The ATM 40 is connected by a sheet transport device 10 to a remote bank note storage safe 50 and air flow generator 52. When a cardholder initiates a cash withdrawal procedure at the ATM 40, bank notes held in the remote safe 50 can be transferred to the delivery slot 48 by the transport device 10.

It will be appreciated that the ATM 40 does not require either the usual heavy and bulky safe, or a bulky internal transport mechanism. The ATM 40 can therefore be substantially smaller in size and lighter in weight than a conventional ATM.

It is an advantage of a sheet transport device according to the invention that it need not follow a straight path. The tube 12 can follow changes direction as great as 90° as illustrated, and in a building can be routed inside walls or in ceiling or under floor spaces.

The transport device 10 can be regarded as analogous to a gas or water pipe and, as shown in FIG. 4 can be bent around corners to follow a convenient route. The device can also be arranged to have branches so that transport path divide or converge.

If required, the sheet transport device 10 can pass through or incorporate note screening or note validation equipment of conventional form.

Figure 5:
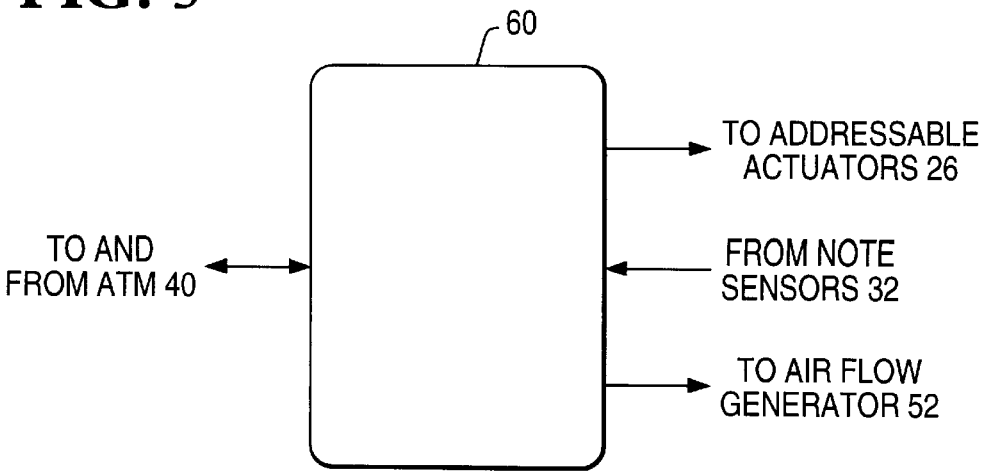
FIG. 5 indicates a suitable computer control system for a sheet transport device.

FIG. 5 shows a personal computer 60 for controlling a sheet transport device and ATM as illustrated in FIG. 4. The PC 60 has a conventional connection to the ATM 40, which is operable in a conventional manner. The PC is also arranged to control the addressable actuators 26 so that they operate in a required sequence; the air flow generator 52 to provide a required level of air flow; and to receive signals from the note sensors 32.

A sheet transport device as described herein can also be used within an ATM which incorporates a safe for bank note storage; in such an application, the device gives more effective internal transport by replacing conventional mechanical bank note transfer arrangements of belts and spur gears, which tend to be both noisy and inefficient.

A sheet transport device as described can also be used to transport cheques or other valuable paper items, the flexibility of the paper allowing the device to be bent around corners. If straight-line transport only is required, the device could be used to transport rigid sheets such as credit cards or smart cards.

What is claimed is:

1. A sheet transport device comprising:

a tube having a cross sectional area and a lengthwise dimension;

means for providing a flow of air along the lengthwise dimension of the tube; and means for varying pressure of the flow of air along the lengthwise dimension of the tube to provide a local Venturi effect which moves along the lengthwise dimension of the tube to transport a sheet along the lengthwise dimension of the tube.

2. A sheet transport device according to claim 1, wherein the means for varying pressure of the flow of air includes means for reducing a cross sectional area of the tube.

3. A sheet transport device according to claim 2, wherein the tube is of rectangular cross section, and the means for reducing a cross sectional area of the tube includes a plurality of operable flaps extendible inside the tube.

4. A sheet transport device according to claim 3, wherein the flaps are arranged in pairs on opposite walls of the tube.

5. A sheet transport device according to claim 4, wherein the means for reducing a cross sectional area of the tube includes a number of actuators for extending the flaps.

6. An automated teller machine (ATM) system comprising:

an ATM;

a remote bank note storage safe;

a bank note transport device for transporting a note between the ATM and the remote bank note storage safe, the bank note transport device including a tube having a cross sectional area and a lengthwise dimension;

means for providing a flow of air along the lengthwise dimension of the tube; and means for varying pressure of the flow of air along the lengthwise dimension of the tube to provide a local Venturi effect which moves along the lengthwise dimension of the tube to transport a note along the lengthwise dimension of the tube.

7. An ATM according to claim 6, wherein the means for varying pressure of the flow of air includes means for reducing a cross sectional area of the tube.

8. An ATM according to claim 7, wherein the tube is of rectangular cross section, and the means for reducing a cross sectional area of the tube includes a plurality of operable flaps extendible inside the tube.

9. An ATM according to claim 8, wherein the flaps are arranged in pairs on opposite walls of the tube.

10. An ATM according to claim 9, wherein the means for reducing a cross sectional area of the tube includes a number of actuators for extending the flaps.

11. A method of transporting a sheet along a lengthwise dimension of a tube, comprising the steps of:

(a) supplying a flow of air along the lengthwise dimension of the tube; and varying pressure of the flow of air along the lengthwise dimension of the tube to produce a local Venturi effect which moves along the lengthwise dimension of the tube to transport the sheet along the lengthwise dimension of the tube.

12. A method according to claim 11, wherein step (b) includes the step of:

(b-1) reducing a cross sectional area of the tube to vary pressure of the flow of air along the lengthwise dimension of the tube.

13. A method according to claim 11, wherein step (b-1) includes the step of:

(b-1-1) extending a plurality of operable flaps inside the tube to reduce a cross sectional area of the tube to vary pressure of the flow of air along the lengthwise dimension of the tube.

* * * * *

UNITED STATES PATENT AND TRADEMARK OFFICE

CERTIFICATE OF CORRECTION

PATENT NO. : 5,988,631

DATED : November 23, 1999

INVENTOR(S) : James R. Hewit

It is certified that error appears in the above-indentified patent and that said Letters Patent is hereby corrected as shown below:

Column 4, Line 22, before "varying" insert -- (b) --.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*